US006752295B2

(12) United States Patent
Weber

(10) Patent No.: US 6,752,295 B2
(45) Date of Patent: Jun. 22, 2004

(54) DISPENSER DRAIN ATTACHMENT FOR FLOWABLE MEDIA

(75) Inventor: Thomas Weber, Hori (CH)

(73) Assignee: Createchnic AG, Nurensdorf (CH)

( * ) Notice: Subject to any disclaimer, the term of this patent is extended or adjusted under 35 U.S.C. 154(b) by 0 days.

(21) Appl. No.: 10/020,282

(22) Filed: Dec. 14, 2001

(65) Prior Publication Data

US 2002/0074359 A1 Jun. 20, 2002

(30) Foreign Application Priority Data

Dec. 15, 2000 (CH) ..... 2448/2000

(51) Int. Cl.[7] ..... B65D 37/00

(52) U.S. Cl. ..... 222/209; 222/207; 222/212; 222/213

(58) Field of Search ..... 222/209, 212, 222/213, 207, 210, 214, 559, 504; 251/61, 61.1; 137/614.14, 614.18

(56) References Cited

U.S. PATENT DOCUMENTS 2,325,210 A * 7/1943 Swihart ..... 222/382
3,130,877 A * 4/1964 Miller ..... 222/207
3,141,580 A * 7/1964 Rogers ..... 222/213
3,160,329 A * 12/1964 Radic et al. ..... 222/204
3,952,924 A * 4/1976 Benson ..... 222/181.2
4,168,020 A * 9/1979 Benson ..... 222/207
4,330,071 A * 5/1982 Ohlson ..... 222/207
4,440,323 A * 4/1984 Benson ..... 222/209
4,561,571 A * 12/1985 Chen ..... 222/207
4,564,130 A * 1/1986 Eulenburg ..... 222/207
4,741,461 A * 5/1988 Williamson et al. ..... 222/181.2
5,121,856 A * 6/1992 Weiler et al. ..... 222/209
5,316,187 A * 5/1994 Drobish et al. ..... 222/401
5,472,120 A * 12/1995 Stebick et al. ..... 222/153.06
5,507,416 A * 4/1996 Rapchak et al. ..... 222/153.07
5,768,918 A * 6/1998 McKibben ..... 68/17 R

* cited by examiner

*Primary Examiner*—Gene Mancene
*Assistant Examiner*—Frederick C Nicolas
(74) *Attorney, Agent, or Firm*—Edwin D. Schindler

(57) ABSTRACT

A dispenser drain attachment includes a threaded cap having a tapered drain socket and an associated drain tube. The interior of the drain tube has a double diaphragm which seals the drain tube, as well as an elastic gas bellows for dispensing liquid portions by alternating deformation of the diaphragm disks of the double diaphragm, which acts as a one-way valve. Such deformation is the result of pressure conditions which change when the gas bellows is compressed and then again released. The dispenser drain attachment is assembled from only two one-piece structural parts, each of which is produced by a two-component injection molding procedure.

20 Claims, 4 Drawing Sheets

DISPENSER DRAIN ATTACHMENT FOR FLOWABLE MEDIA

BACKGROUND OF THE INVENTION

1. Technical Field of the Invention

The present invention relates to a dispenser drain attachment for containers for different liquid, viscous and gel-type media. More particularly, the present invention relates to a dispenser drain attachment for containers for such liquids as soaps, disinfectants and cleaning or care agents, and is intended, and able to be used, for all types of flowable media which have to be dosed in portions.

The present invention may be used with gels, since even a gel will flow if the diameter of the dispenser drain is dimensioned adequately large, so that the dispenser drain attachment can, as well, be employed for portioning media in the form of a gel.

2. Description of the Prior Art

Dispenser drain attachments are known to exist in the form of various embodiments. These prior art attachments are basically screwable onto the underside of a container, where they tightly seal such container, and permit the withdrawal of predetermined portions of the medium filled in the container. If such dispenser drain attachments are mounted on the underside of the container, this will often suggest that the container is being utilized as a bottle, in which case the dispenser drain attachment is then also screwable onto the mouth of the bottle. For withdrawing portions of the contents of the bottle, the entire bottle is mounted up-side-down on a wall or a holding rack, so that the dispenser drain attachment is finally mounted on the container at the bottom.

Conventional dispenser drain attachments themselves consist of a substantially downward pointing tube having a diaphragm seal installed in its interior that acts as a one-way valve. In one embodiment, such a diaphragm is a "double" diaphragm, i.e., two diaphragms in the form of rubber disks arranged in a spaced apart manner from each other in the dispenser drain tube. Such rubber disks tightly seal the dispenser drain tube at different sites and each acts as a one-way valve, so that liquid basically can flow around the rubber diaphragms only in a top-down manner. For this purpose, the rubber disks have a beveled edge, so that such an edge rests against the inner wall of the dispenser drain tube from the bottom in a sealing manner, analogous to a lip.

The interior of an elastic gas bellows, which is mounted on the outer side of the dispenser drain tube, communicates with the chamber enclosed by the two spaced-apart rubber disks. The gas bellows are formed, for example, by a semi-spherical element having the elasticity of rubber, but may also have another shape, as long as such an element elastically bounds back into its original shape after it has been compressed. For actuating the dispenser drain attachment, a user's finger is pressed into the bellows. In the event that the hands of the user are not free at the time, or are dirty, the bellows can be compressed with the aid of a bow of a special wall bracket by actuating the bow with the elbow and causing it to apply pressure on the bellows with its other end.

When such a dispenser drain attachment is screwed onto a container, the liquid filled in the container will first flow up to the first rubber diaphragm only, as viewed from the top-down. When the gas bellows are compressed for the first time, the gas pressure in the chamber between the two spaced-apart rubber diaphragms rises. The upper rubber diaphragm remains tight in this process, and its edge acting as a seal lip is pressed against the inner wall of the dispenser attachment with an even greater force, thereby further enhancing its tightness. As a result, the lower rubber diaphragm yields to the pressure of the gas, and gas or air consequently escape around the lower diaphragm downwards through the dispenser drain tube. When the gas bellows is released again, it rebounds back into its original shape, because of its elasticity and a vacuum is generated between the two rubber diaphragms.

As a consequence, the dispenser drain tube is tightly sealed by the lower rubber diaphragm under such vacuum, because its sealing lip is tightly pressed from below to the inner wall of the tube under the increased external, i.e., atmospheric pressure, whereas the upper rubber diaphragm yields to the atmospheric pressure acting from the top, thereby permitting the flow of liquid around the sealing lip downwards, so that the chamber between the two rubber diaphragms is virtually filled up with liquid. When the gas bellows are compressed again, the lower diaphragm is opened by the pressure generated in the chamber between the two rubber diaphragms, and liquid flows around the diaphragms downward and out of the tube. The upper rubber diaphragm, by contrast, remains tight, or its tightness is increased even more so, by the increased pressure acting from the bottom. After the bellows has been released, a vacuum is generated again vis-à-vis the external pressure, which causes the lower rubber diaphragm to be closed, whereas the upper rubber diaphragm opens and new liquid can flow into the chamber between the two rubber diaphragms. Thus, the chamber is filled for further portioning, whereby the liquid, however, is retained by the lower rubber diaphragm until the gas bellows is actuated the next time.

The dispenser drain attachments known to the prior art, which function in the manner described above, require much expenditure for their manufacture. Such dispenser drain attachments are comprised of a multitude of small components, which are manufactured from different types of plastic material, using plastic injection molding technology. Individual parts or small components may be made of metal, as well. Such a dispenser drain attachment is comprised of a threaded cap, which is screwed to the external thread of the outlet of a container. The threaded cap has a tapering drain socket, on which an O-ring made of rubber is installed in an annular groove extending entirely around. The drain socket is sealed, in front, by a terminating element, which, however, has a plurality of holes through which liquid can flow outwardly. A drain tube is then plugged over the drain socket. The drain tube is tapered, as well, toward the end of its orifice, but it is offset, not coaxially, but rather sideways, so that the outer wall of the drain tube extends along a straight line on the one side; whereas it is offset on the opposite side, in accordance with the tapered shape of the mouth of the tube in the direction toward the center of the drain tube.

An extension is molded in the center of the drain tube, in the interior of the latter, at the site where the large diameter merges into the small diameter. The extension extends in the axial direction against the side of the tube having the larger diameter. The extension has a central axial bore for receiving a metal or plastic pin on which a double diaphragm made of rubber is mounted. The double diaphragm forms a one-piece rubber body that is substantially comprised of two rubber disks, which are aligned parallel with one another and spaced away from each other via a hollow axle. The edge of each of the rubber disks is beveled. The metal or plastic pin penetrates the double diaphragm and projects into a central bore located in the terminating element of the drain socket. Thus, the double diaphragm is centrally supported in the drain tube and held on both sides, i.e., at the top and bottom. On the drain tube, on the one side where the exterior of the tube extends along a straight line, a receiving sleeve is molded onto the drain tube. The interior of the sleeve communicates via a bore with the chamber located between the two rubber disks of the double diaphragm, and the edge of the sleeve is slightly bulging on the inner side. A gas bellow made of elastic material and substantially forming a semispherical element can be pressed into the sleeve. It is supported in the sleeve via an additional sealing ring, which is turned inside-out over the gas bellows from the outside and snap-locked behind the bulging edge of the sleeve.

All of the components, which amount to seven in the described example, have to be produced separately and then assembled in a mounting operation requiring much expenditure. However, wherever assembly work is required, the potential for errors during assembly cannot be excluded. Such errors are often the cause of malfunctions, i.e., in that the dispenser drain attachments are, for example, leaking or not capable of holding the liquid back in the container, or are leaky along the edge of the bellows.

SUMMARY OF THE INVENTION

It is, therefore, an object of the present invention to provide a dispenser drain attachment for flowable media which is manufactured from substantially fewer components and therefore capable of being manufactured at a substantially lower cost.

It is an additional object of the present invention to provide a dispenser drain attachment for flowable media which is able to be more simply, and readily, assembled and therefore less prone to the occurrence of errors in the assembly procedure.

It is, yet, a further object of the present invention to provide a dispenser drain attachment for flowable media having virtually 100% tightness in its construction and overcoming the inherent deficiencies of such prior art attachments.

The foregoing and related objects are accomplished by the present invention for a dispenser drain attachment, which includes a threaded cap having a tapered drain socket and an associated drain tube. The interior of the drain tube has a double diaphragm which seals the drain tube, as well as an elastic gas bellows for dispensing liquid portions by alternating deformation of the diaphragm disks of the double diaphragm, which acts as a one-way valve. Such deformation is the result of pressure conditions which change when the gas bellows is compressed and then again released. The dispenser drain attachment is assembled from only two one-piece structural parts, each of which is produced by a two-component injection molding technique.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1:
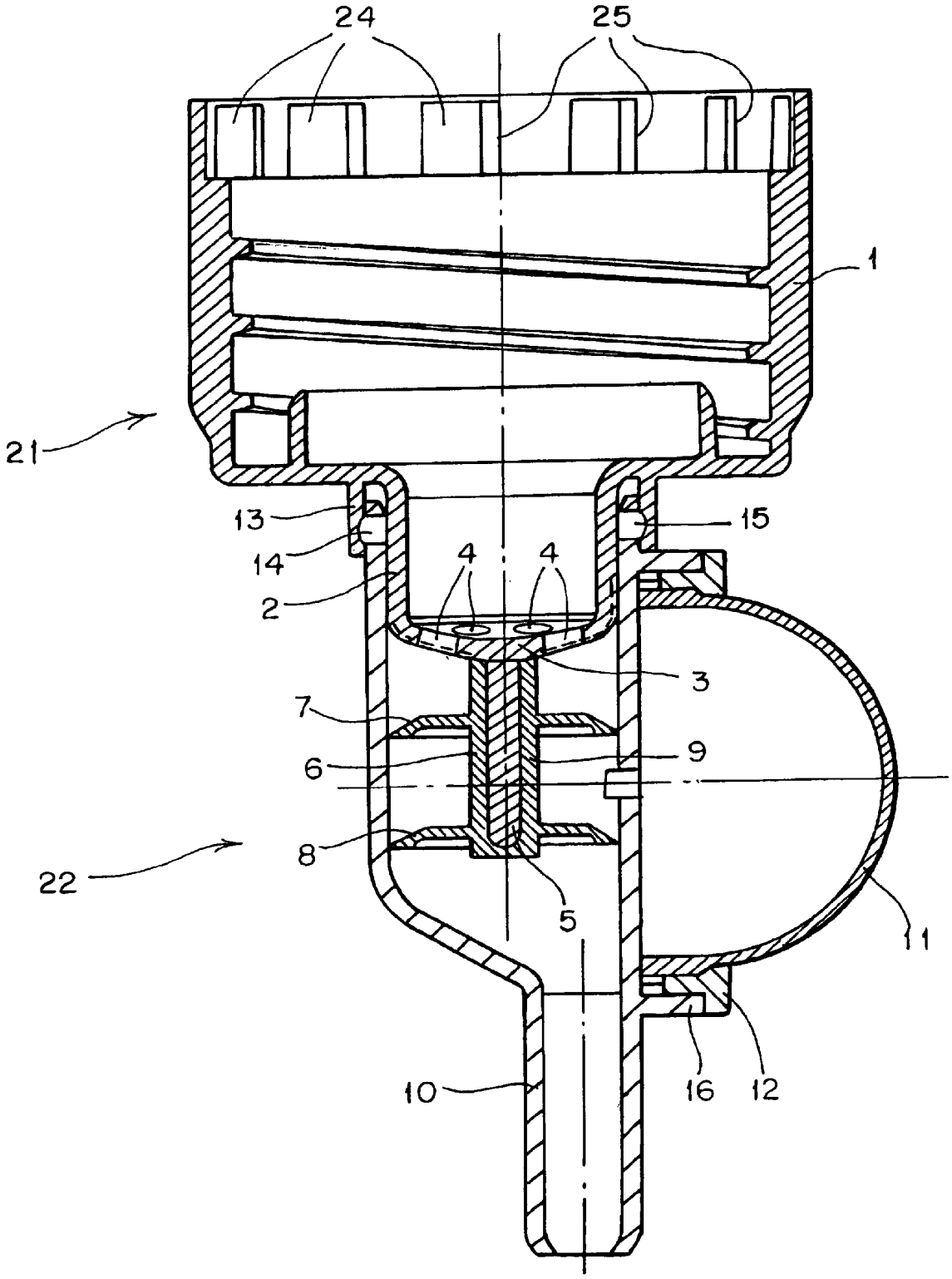
FIG. 1 is a side, sectional view of the assembled dispenser drain attachment of the present invention.

Turning now, in detail, to an analysis of the drawing figures, FIG. 1 shows the dispenser drain attachment of the present invention as being already assembled, whereby all of the components are visible. The dispenser drain attachment is comprised of two one-piece structural parts 21, 22, each produced via a two-component injection molding technique.

The first part 21 forms a threaded cap 1, which on its underside, has a tapering drain socket 2, that is sealed in front via a terminating element 3, the latter, however, being penetrated by a plurality of holes 4. A multitude of inwardly projecting ribs 24, which each have a sharp marginal edge 25, are arranged slanted in relation to the circumference along the inner edge of threaded cap 1 and above its thread. As the threaded cap 1 is being screwed onto an orifice provided with an outer thread, said inwardly projecting ribs 24 develop the effect of a ratchet and, thus, assure that the screwed-on threaded cap is secured in this position. An extension 5 is centrally molded onto the connection surface 3 of drain socket 2, and extends in a bolt-like manner along the axis of symmetry of threaded cap 1, somewhat further downward.

All of the components of the first structural part 21 are produced from a first injection molding component, notably from a suitable polyolefin, i.e., a polypropylene or polyethylene, or from a polyamide. Now, a double diaphragm 6, representing the second injection molding component of the first structural component 21, is injection-molded onto an extension 5 to a connection surface 3. Double diaphragm 6 is comprised of an injection-moldable material having the elasticity of that of substantially rubber, for example, a thermoplastic elastomer or an injection-moldable rubber, and forms two diaphragm disks 7, 8, which are spaced apart from each other and seated on a common axis 9. The outer edge of said diaphragm disks 7, 8, is slanted downwards, so that said edge rests against a drain tube 10 from the bottom upwardly, in a manner analogous to a lip. The drain pipe with gas bellows 11 forms the second one-piece structural part 22 of the dispenser drain attachment of the present invention.

The second structural part 22 is, as well, comprised of two separate injection molding components. The drain tube 10, the lateral sleeve 16 and a holding ring 12, for retaining the rubber-like elastic gas bellows 11, are injection molded from the first injection molding component, whereas gas bellows 11, itself, is injection-molded from a second component.

It will now be explained in greater detail how drain tube 10, with gas bellows 11, is structured and injection-molded. For their assembly, the two structural parts 21, 22 are readily plugged one onto the other. For this purpose, a receiving collar 13 is formed on threaded cap 1, extending around its drain socket 2. Receiving collar 13 belongs to threaded cap 1, thereby forming one single piece with the latter. As a result of receiving collar 13, an annular groove is formed between the receiving collar itself and drain socket 2; said annular groove extending entirely around drain socket 2. On its upper inner side, receiving collar 13 has a recess 14 extending all around. On the other hand, the end segment of the drain tube 10 and, thus, the second one-piece structural part 22, have a bulge 15 extending entirely around on the outer side. When the two structural parts 21, 22 are plugged together, bulge 15 snaps precisely into a recess 14 and fits into the recess in a sealing manner. This permits the two structural parts 21, 22 to be simply plugged together, so as to produce a connection that is tension-proof and tight. Furthermore, drain tube 10 clings tightly to the outer surface of drain socket 2, so that it is correctly guided on the latter, thereby making certain that double diaphragm 6 will come to rest in the interior of drain tube 10 correctly centered and, consequently, will safely seal the dispenser drain attachment against unintended draining of liquid. Furthermore, the joint is sufficiently strong to afford the force of reaction required in order to tightly retain the dispenser drain when the bellows are also compressed.

Figure 2:
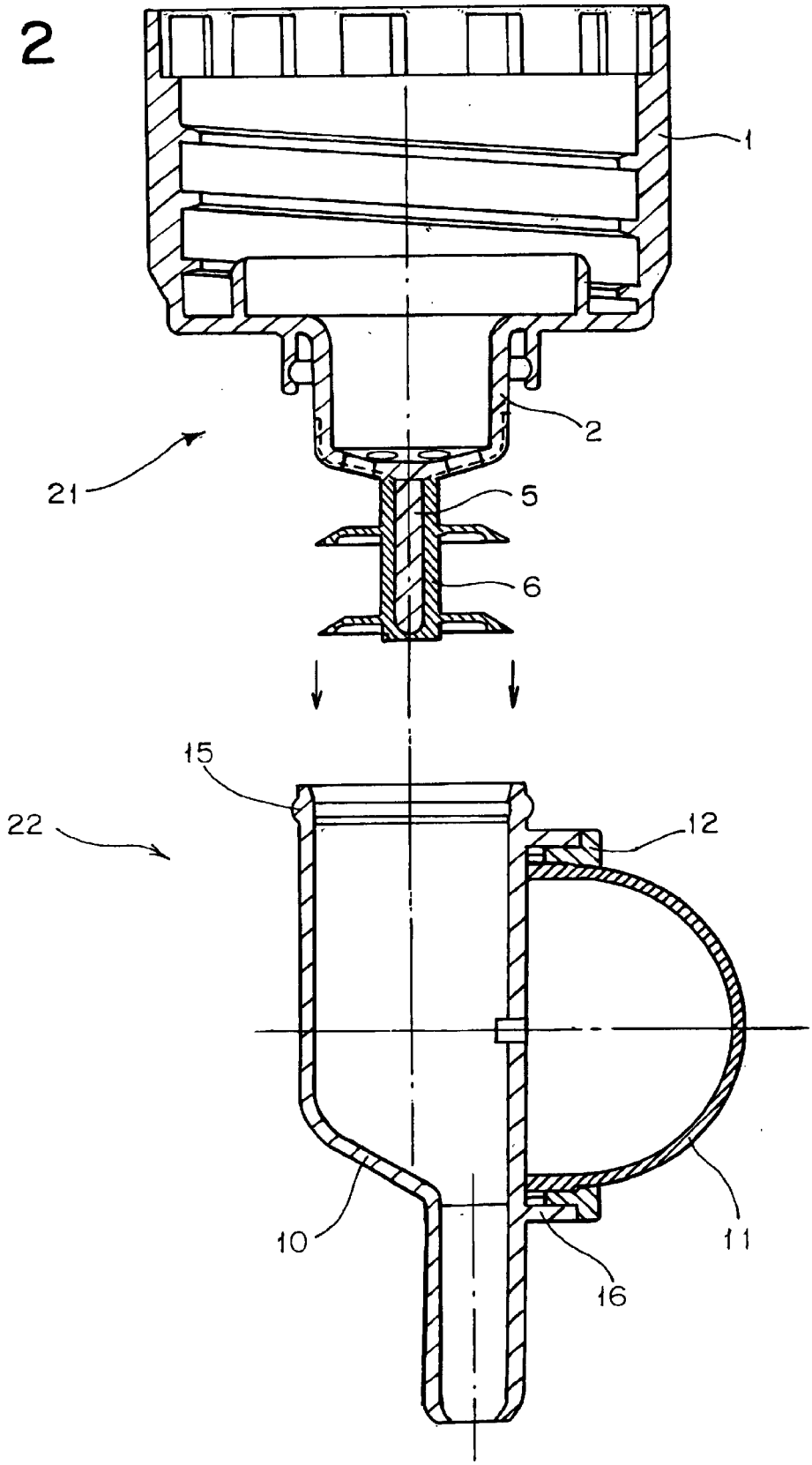
FIG. 2 shows the two one-piece structural parts, each produced by the two-component injection molding technique, next to each other before they were plugged together, each of said parts being shown via a side, sectional view.

FIG. 2 shows, separately, two one-piece structural parts produced via the two-component injection molding technique, in their positions relative to one another before they are plugged together. Threaded cap 1 with drain socket 2 and extension 5 are injection molded onto the latter from the first injection molding component, and double diaphragm 6 is injection molded onto extension 5 as the second injection molding component, thereby jointly forming the first one-piece structural part 21 of the dispenser drain attachment.

The second structural part 22, which is a one-piece part, as well, is shown and visible underneath. Part 2 is comprised of drain tube 10 and lateral sleeve 16 being injection-molded thereon, with holding ring 12 for retaining gas bellows 11. Drain tube 10, lateral sleeve 16 and retaining ring 12, with an inserting collar 26 (see, FIG. 3B) molded therearound, are produced from the first injection molding component, whereas elastic gas bellows 11 is produced from the second injection molding component.

FIGS. 3A and 3B shows drain tube 10 with lateral receiving sleeve 16 and retaining ring 12, with inserting collar 26, for retaining gas bellows 11 in the injection-molding position after a first injection molding component has been injected. The second structural part 22 can be seen here from the right-hand side in FIGS. 1 and 2. Receiving sleeve 16 comprises an edge 17, which is slightly bulging on its inner side, or the inner wall of receiving sleeve 16, is slightly offset outwards behind edge 17. Retaining ring 12 is connected with lateral receiving sleeve 16 via a film hinge 18; it has an edge which is slightly bulging on its outer side in an edge zone 20. Retaining ring 12 can be folded over and around film hinge 18 by 180° and clipped into lateral receiving sleeve 16, in that its bulging edge 20 snaps in behind the budging inner edge of lateral receiving sleeve 16, and will then rest tightly against the inner wall of lateral receiving sleeve 16, with inserting collar 26 being capable of being tightly clipped into said lateral receiving sleeve 16.

Figure 3:
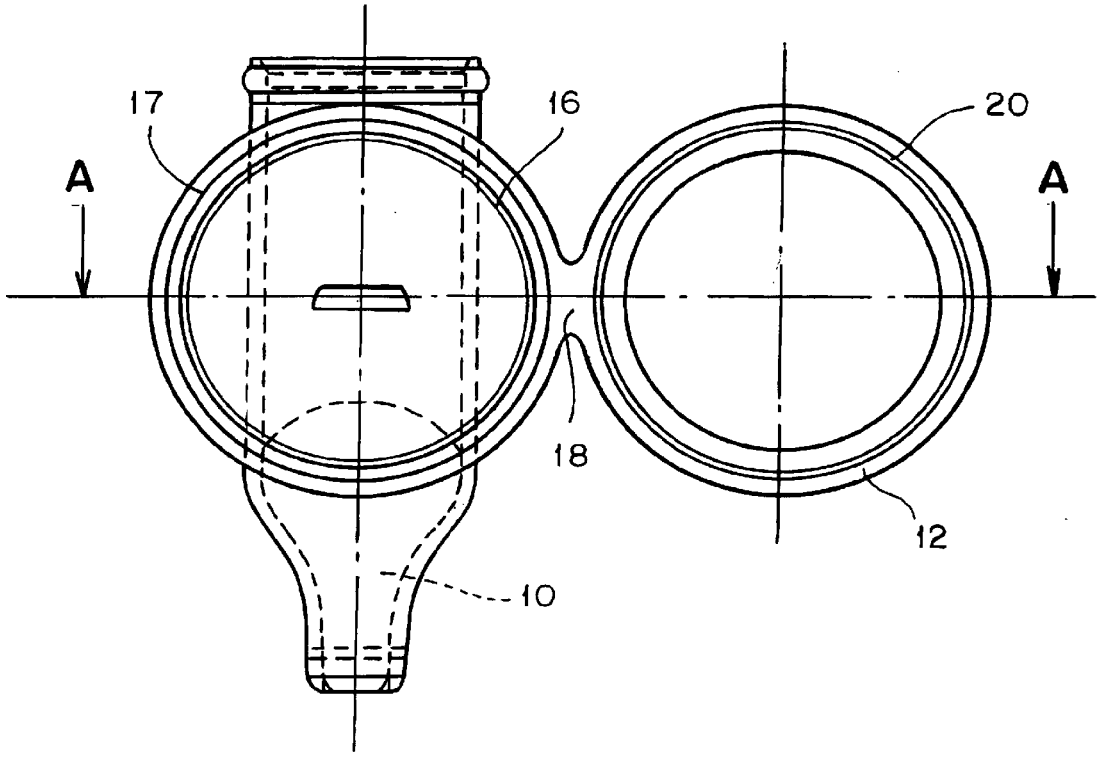
FIG. 3A shows the drain tube of the present invention with a receiving ring for accommodating the gas bellows in the injection molding position after the first component has been produced by injection molding.
FIG. 3B shows the drain tube of the present invention with the inserting collar and edge zone of the retaining ring of FIG. 3A.
Figure 4:
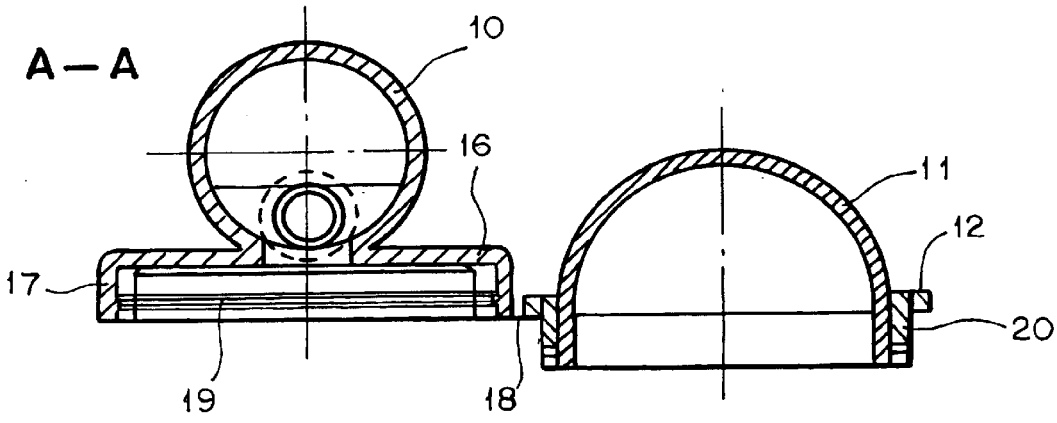
FIG. 4 shows the drain tube with the receiving ring for receiving the gas bellows in the injection molding position after the second component has been produced by injection molding; and, FIG. 5 shows the two one-piece parts, each produced via the two-component injection molding technique, before the two parts are plugged together.

FIG. 4 shows a sectional view of drain tube 10 with gas bellows 11, representing the second injection molding component already molded on in the injection molding position, as viewed along the line A—A in FIG. 3. The lateral receiving sleeve 16, for receiving retaining ring 12, can be seen; the latter being connected thereto via film hinge 18. Film hinge 18 makes it possible to injection-mold drain tube 10 together with lateral receiving sleeve 16 and retaining ring 12 in an expeditious manner. The representation shown in the drawing figures illustrates a bulging inner edge 19 of lateral receiving sleeve 16, as well as bulging outer edge 20 of retaining ring 12. Elastic gas bellows 11 is injection-molded onto said retaining ring 12 via a second injection molding component. Thereafter, the second one-piece structural part 22 for the dispenser drain attachment is completed.

Figure 5:
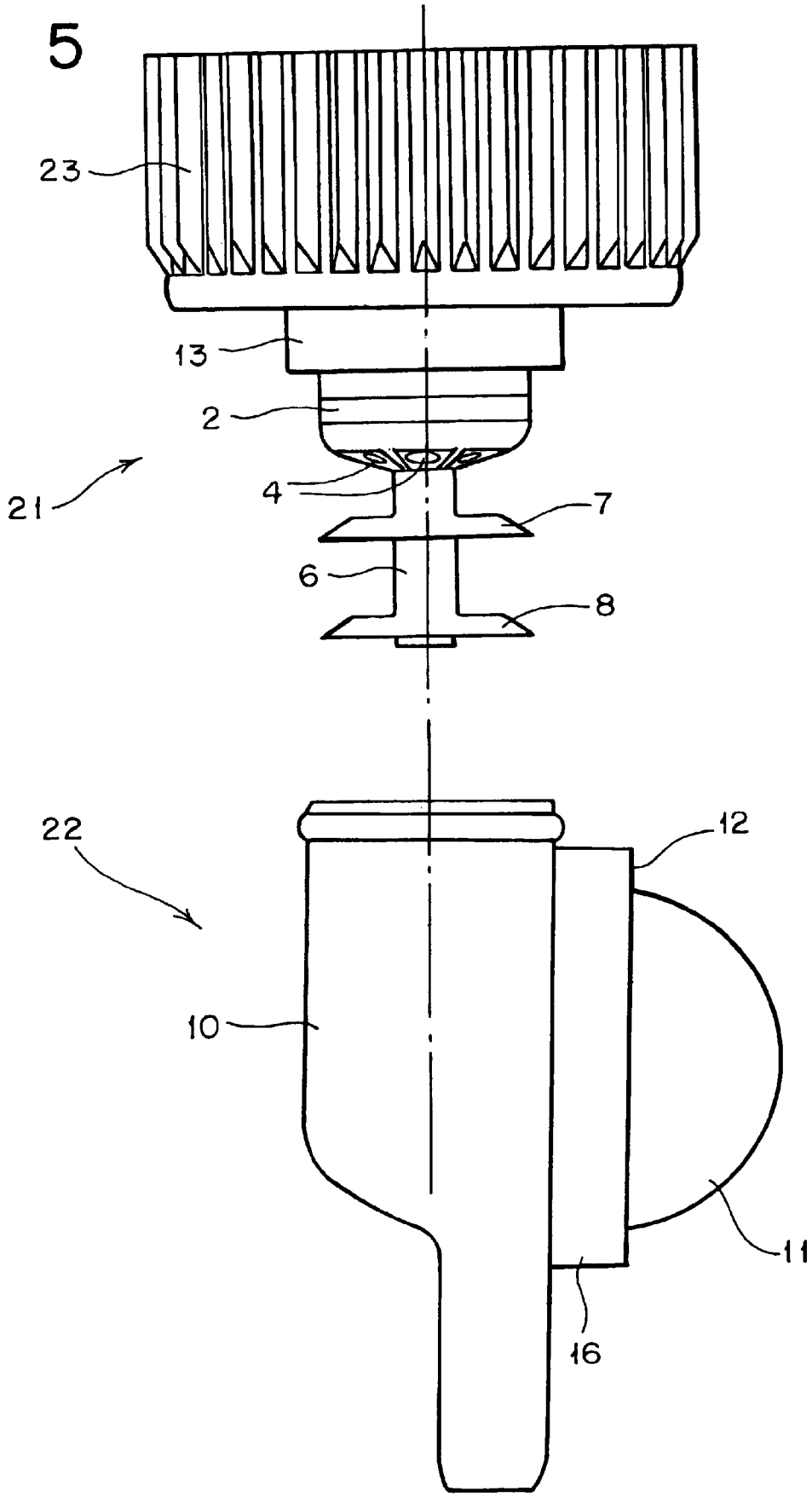

Finally, FIG. 5 shows the finished one-piece structural parts 21, 22, each injection-molded by the injection molding technique before they are then plugged together. Visible in FIG. 5 is the plurality of holes 4 provided in the connection surface of drain socket 2, as well as receiving collar 13, extending around drain socket 2. On its outer side, threaded cap 1 is provided with a knurling 23, so that the dispenser drain attachment can be safely gripped when it is screwed to the mouth of a bottle. Double diaphragm 6, with the two spaced-apart diaphragm disks 7, 8, can be seen below drain socket 2. The laterally mounted lateral receiving sleeve 16, for accommodating retaining ring 12, and gas bellows 11, supported by said retaining ring 12, are visible on drain tube 10, as shown underneath. The bulged edge 20 is visible on the upper edge of the orifice of drain tube 10. When plugged to the first structural part 21, the bulged edge fits into a corresponding recess located on the inner edge of receiving collar 13.

While only several embodiments of the present invention have been shown and described, it will be obvious to those skilled in the art that many modifications may be made to the present invention without departing from the spirit and scope thereof.

What is claimed is:

1. A dispenser drain attachment, comprising:

a first one-piece structural part forming a threaded cap with a tapering drain socket having an extension and a double diaphragm with deformable diaphragm disks on said extension, said first one-piece structural part being made in an injection molding procedure;

a second one-piece structural part forming a drain tube for receiving said double diaphragm for sealing said drain tube, said second one-piece structural part further including an elastic gas bellows for dispensing a flowable media by alternately deforming said deformable diaphragm disks of said double diaphragm as one-way valves resulting from changed pressure conditions occurring when said elastic gas bellows is deformed via compression and release, said second one-piece structural part being made in an injection-molding procedure; and, means for attaching said first one-piece structural part to said second one-piece structural part, said means for attaching being formed as an integral part of at least one of said first one-piece structural part or said second one-piece structural part, said dispenser drain attachment comprising of said first one-piece structural part and said second one-piece structural part with each of said one-piece structural parts made via two-component injection molding comprising a first component and a second component, whereas said second component for said double diaphragm with its said deformable diaphragm disks and for said elastic gas bellows being a softer and more flexible material than said first component for said threaded cap with said tapering drain socket and for said drain tube, there being a lateral receiving sleeve shaped on an outer side of said drain tube, said lateral receiving sleeve merging on one side into a film hinge, onto which a retaining ring with an inserting collar is molded, said inserting collar being capable of being tightly clipped into said lateral receiving sleeve.

2. The dispenser drain attachment according to claim 1, wherein said tapered drain socket of said threaded cap of said first one-piece structural part has a perforated terminating element with said extension, with said double diaphragm of said second one-piece structural part being molded onto said extension.

3. The dispenser drain attachment according to claim 1, wherein said double diaphragm is made of an elastic, injection-moldable rubber material.

4. The dispenser drain attachment according to claim 1, wherein said drain socket of said first one-piece structural part and said drain tube of said second one-piece structural part are injection-molded from a polyolefin.

5. The dispenser drain attachment according to claim 4, wherein said polyolefin is a member selected from the group consisting of polypropylene, polyethylene and polyamide.

6. The dispenser drain attachment according to claim 1, wherein said double diaphragm and said elastic gas bellows are injection-molded from a thermoplastic elastomer.

7. The dispenser drain attachment according to claim 1, further comprising a receiving collar molded around said drain socket on said threaded cap, said receiving collar having a recess extending entirely around its inner wall, with a bulge extending entirely around an upper edge of a mouth of said drain tube and fitting into said recess.

8. The dispenser drain attachment according to claim 1, wherein said lateral receiving sleeve includes a bulging inner edge with a retaining ring connected with said lateral receiving sleeve via said film hinge comprising an inserting collar with a bulging outer edge, so that said retaining ring is clipable onto said lateral receiving sleeve in a sealing manner so that said inserting collar of said retaining ring is able to fit tightly into said lateral receiving sleeve.

9. The dispenser drain attachment according to claim 8, wherein said retaining ring is pivotable by 180° onto said lateral receiving sleeve and tightly clipped onto said lateral receiving sleeve.

10. The dispenser drain attachment according to claim 1, wherein said means for attaching said first one-piece structural part to said second one-piece structural part includes tightly plugging said first one-piece structural part with said second one-piece structural part.

11. A method for manufacturing a dispenser drain attachment, said dispenser drain attachment including:

a first one-piece structural part forming a threaded cap with a tapering drain socket having an extension and a double diaphragm with deformable diaphragm disks on said extension, said first one-piece structural part being made in an injection molding procedure;

a second one-piece structural part forming a drain tube for receiving said double diaphragm for sealing said drain tube, said second one-piece structural part further including an elastic gas bellows for dispensing a flowable media by alternately deforming said deformable diaphragm disks of said double diaphragm as one-way valves resulting from changed pressure conditions occurring when said elastic gas bellows is deformed via compression and release, said second one-piece structural part being made in an injection-molding procedure; and, means for attaching said first one-piece structural part to said second one-piece structural part, said means for attaching being formed as an integral part of at least one of said first one-piece structural part or said second one-piece structural part, said dispenser drain attachment comprising of said first one-piece structural part and said second one-piece structural part with each of said one-piece structural parts made via two-component injection molding comprising a first component and a second component, whereas said second component for said double diaphragm with its said deformable diaphragm disks and for said elastic gas bellows being a softer and more flexible material than said first component for said threaded cap with said tapering drain socket and for said drain tube, there being a lateral receiving sleeve shaped on an outer side of said drain tube, said lateral receiving sleeve merging on one side into a film hinge, onto which a retaining ring with an inserting collar is molded, said inserting collar being capable of being tightly clipped into said lateral receiving sleeve, said method comprising the steps of:

(a) a two-component injection-molding procedure for making said first one-piece structural part;

(b) a two-component injection-molding procedure for making said second one-piece structural part; and, (c) attaching said first one-piece structural part to said second one-piece structural part to complete manufacture of said dispenser drain attachment.

12. The method for manufacturing a dispenser drain attachment according to claim 11, wherein said tapered drain socket of said threaded cap of said first one-piece structural part has a perforated terminating element with said extension, with said double diaphragm of said second one-piece structural part being molded onto said extension.

13. The method for manufacturing a dispenser drain attachment according to claim 11, wherein said double diaphragm is made of an elastic, injection-moldable rubber material.

14. The method for manufacturing a dispenser drain attachment according to claim 11, wherein said drain socket of said first one-piece structural part and said drain tube of said second one-piece structural part are injection-molded from a polyolefin.

15. The method for manufacturing a dispenser drain attachment according to claim 14, wherein said polyolefin is a member selected from the group consisting of polypropylene, polyethylene and polyamide.

16. The method for manufacturing a dispenser drain attachment according to claim 11, wherein said double diaphragm and said elastic gas bellows are injection-molded from a thermoplastic elastomer.

17. The method for manufacturing a dispenser drain attachment according to claim 11, further comprising a receiving collar molded around said drain socket on said threaded cap, said receiving collar having a recess extending entirely around its inner wall, with a bulge extending entirely around an upper edge of a mouth of said drain tube and fitting into said recess.

18. The method for manufacturing a dispenser drain attachment according to claim 11, wherein said lateral receiving sleeve includes a bulging inner edge with a retaining ring connected with said lateral receiving sleeve via said film hinge comprising an inserting collar with a bulging outer edge, so that said retaining ring is clipable onto said lateral receiving sleeve in a sealing manner so that said inserting collar of said retaining ring is able to fit tightly into said lateral receiving sleeve.

19. The method for manufacturing a dispenser drain attachment according to claim 18, wherein said retaining ring is pivotable by 180° onto said lateral receiving sleeve and tightly clipped onto said lateral receiving sleeve.

20. The method for manufacturing a dispenser drain attachment according to claim 11, wherein said means for attaching said first one-piece structural part to said second one-piece structural part includes tightly plugging said first one-piece structural part with said second one-piece structural part.

* * * * *